United States Patent [19]

Saitoh

[11] Patent Number: 4,991,519

[45] Date of Patent: Feb. 12, 1991

[54] INCINERATING FURNACE

[76] Inventor: Shigeru Saitoh, 169 Dai, Obamamachi Iwaki-shi Fukushima-Prefecture, Japan

[21] Appl. No.: 467,952

[22] Filed: Jan. 22, 1990

[30] Foreign Application Priority Data

Jan. 31, 1989 [JP] Japan ..... 1-19665

[51] Int. Cl.[5] ..... F23G 5/00; F23G 5/12

[52] U.S. Cl. ..... 110/235; 110/108; 110/165 R; 110/255; 110/256; 116/259; 116/118

[58] Field of Search ..... 110/255, 259, 165 R, 110/245, 243, 256, 235, 108, 118

[56] References Cited

U.S. PATENT DOCUMENTS

| | | | |
|---|---|---|---|
| 510,550 | 12/1893 | Richards | 110/118 |
| 3,805,713 | 4/1974 | Notary et al. | 110/165 R X |
| 4,330,502 | 5/1982 | Engstrom | 110/245 X |
| 4,503,783 | 3/1985 | Musschoot | 110/165 R |
| 4,539,917 | 9/1985 | Mallon et al. | 110/256 |
| 4,757,771 | 7/1988 | Narisoko et al. | 110/245 |

*Primary Examiner*—Edward G. Favors

*Attorney, Agent, or Firm*—Flynn, Thiel, Boutell & Tanis

[57] ABSTRACT

An incinerating furnace which utilizes mineral particles as a hearth bed. Hearth particles are supplied and automatically flow down by gravity into the combustion chamber and onto a movable plane member, such as a rotary table, disposed at the bottom of the furnace. A mixture of used hearth particles and the combustion remainder is removed from the outlet of the furnace as the movable plane member moves and introduced into a receiving tank. Supplemental hearth particles are supplied from a hopper into the combustion chamber and form an oblique hearth bed where incineration takes place.

9 Claims, 8 Drawing Sheets

INCINERATING FURNACE

BACKGROUND OF THE INVENTION

1. Field of the Invention

The present invention relates to an improvement in an incinerating furnace utilizing mineral particles as a hearth bed, particularly to an improvement in removing used hearth particles and combustion remainder from the incinerating furnace.

2. Prior Art

It is known to use an incinerating furnace having a hearth bed consisting of mineral particles for incinerating plastic wastes which have a high calorific value and emit corrosive gases.

There are two types of incinerating furnaces having a hearth consisting of mineral particles. One is a fixed hearth and the other is a movable hearth. In the movable hearth furnaces the used hearth particles are taken out by a belt conveyer, by a rotating cylinder or by a rotating gear.

Incinerating furnaces of this kind are disclosed in Japanese Patent specification Sho No. 51-3139 (Kokoku No. 76-3139), Sho No. 52-21832 (Kokoku No. 77-21832) and Sho No. 56-685 (Kokoku No. 81-685), of which the hearths, consisting of mineral particles, are taken out by a belt conveyer disposed in the combustion chamber, Japanese laid open Sho No. 58-10831 (Kokai No. 83-10318), of which the hearth consisting of mineral particles is taken out by a rotary drum, and Japanese laid open Sho No. 63-217127 (Kokai No. 88-217127), of which the hearth consisting of mineral particles is taken out by a rotary gear.

Recently the need to incinerate used plastic equipment, such as plastic disposable injectors packed in a large plastic bag in incinerating furnaces of this kind has grown.

After the incineration of materials to be incinerated, for example, plastic wastes, a combustion remainder of large dimension often remains in combustion chambers of the incinerating furnace. They are very difficult remove from the incinerating furnace because the size of the outlet of the combustion remainder is fixed and generally is not large enough for allowing their removal.

GENERAL DESCRIPTION OF THE INVENTION

This invention intends to solve the above mentioned problems and, even when the materials to be incinerated emit corrosive gases, such as HCl, SOx, NOx, or bad smelling gases, the incinerating furnace according to this invention will prevent the emission of those harmful gases to the surrounding environment.

This invention also provides complete combustion in the incinerating furnace, keeps the furnace hearth particle bed in good condition, and prevents the wall and bed of the incinerating furnace from being damaged by the flame.

It is easy, according to this invention, to remove comparatively large sized combustion remainder from the incinerating furnace.

DETAILED DESCRIPTION OF THE INVENTION

Mineral particles applicable to the incinerating furnaces of this invention are natural stones, such as crushed stones, gravels and coarse sand, which must be durable in high temperatures and form sufficient gaps therebetween for air to be supplied to the combustion chamber when filled therein as a hearth bed, and the mean diameter of the hearth particles is from 5 mm to 3 cm. It is desirable to select crushed stones as hearth particles because the angle of repose of the crushed stones is quite large.

Now the construction of the outlet of the incinerating furnace of this invention will be explained according to the attached drawings from FIG. 1 to FIG. 7, FIG. 13 and FIG. 14.

Figure 1:
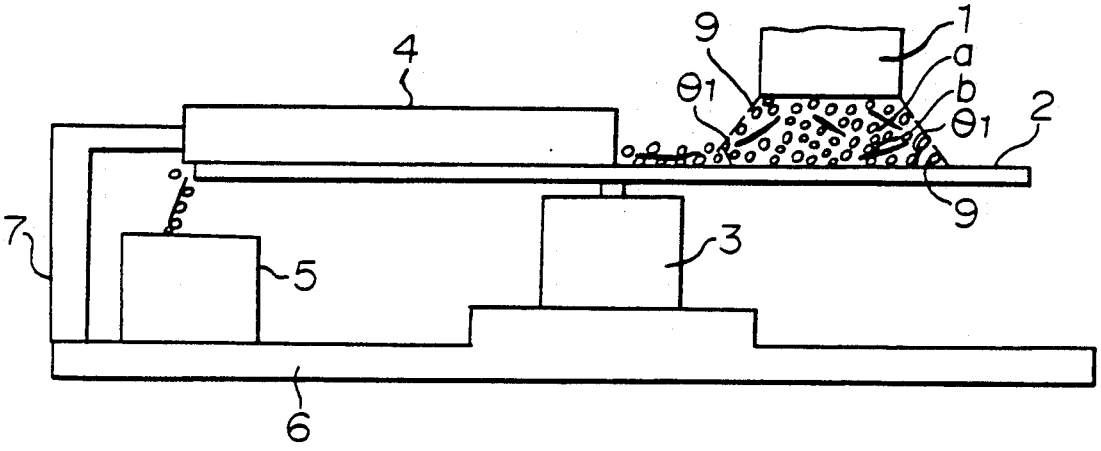
FIG. 1 is a side view of the slag outlet of this invention.
Figure 2:
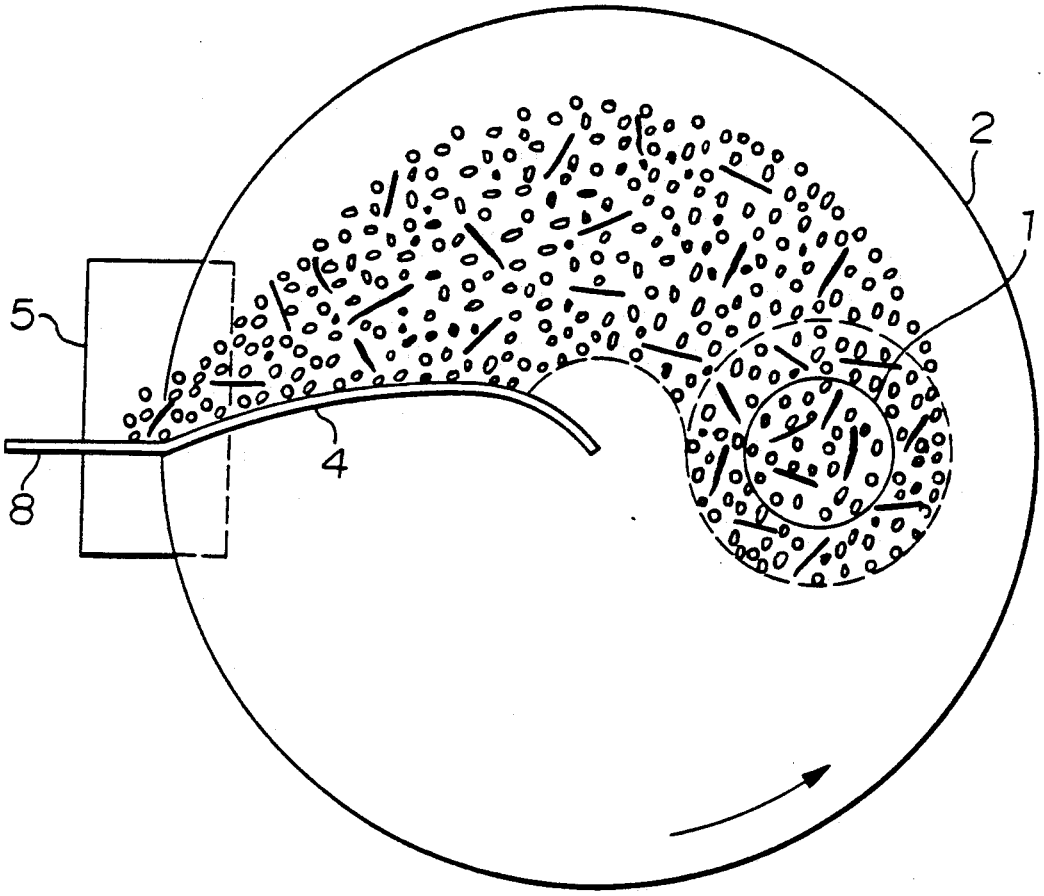
FIG. 2 is a plan view of this invention.

In FIG. 1 and FIG. 2, a mixture of a combustion remainder (b) of the materials to be incinerated and used hearth particles (a) (referred to as the mixed remainder hereinafter) slides or rolls down from the outlet 1 of the incinerating furnace and accumulates on the movable plane member 2 forming a pile of the particles. The movable plane member 2 is driven by the driving unit 3 mounted on the support 6. As the movable plane member 2 moves, the pile of the mixed remainder is taken out to the collecting guide 4 which extends laterally from the arm 7. Then the mixed remainder is introduced into the receiving tank 5 by the guide.

The collecting guide 4 may also be secured to the incinerating furnace wall near the outlet 1 or to other parts if desired.

The used hearth particles among the mixed remainder introduced in the receiving tank 5 are recovered by separation through a sieve, washed, and/or refined and then returned to the supply hopper 13 of the hearth particles for recycling.

Figure 4:
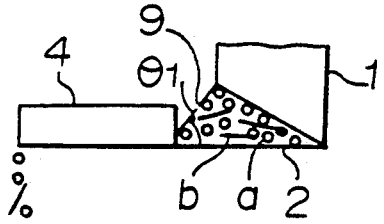
FIG. 4 and FIG. 5 are schematic diagrams indicating different types of outlet structures.

The outlet 1 is disposed preferably just above and within the area of the movable plane member 2 at a certain distance from the outlet, and the edge of the outlet 1 may be perpendicular to the movable plane member 2 or oblique thereto as illustrated in FIG. 4.

Figure 5:
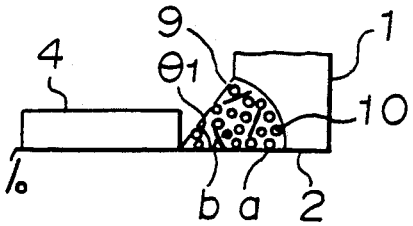

The cross section of the outlet 1 may be circular, square or any other appropriate section and a part of the section can be cut off as illustrated in FIG. 5.

The outlet 1 is not necessarily disposed just above the center of the movable plane member 2 but within the area of the movable plane member 2.

Figure 3:
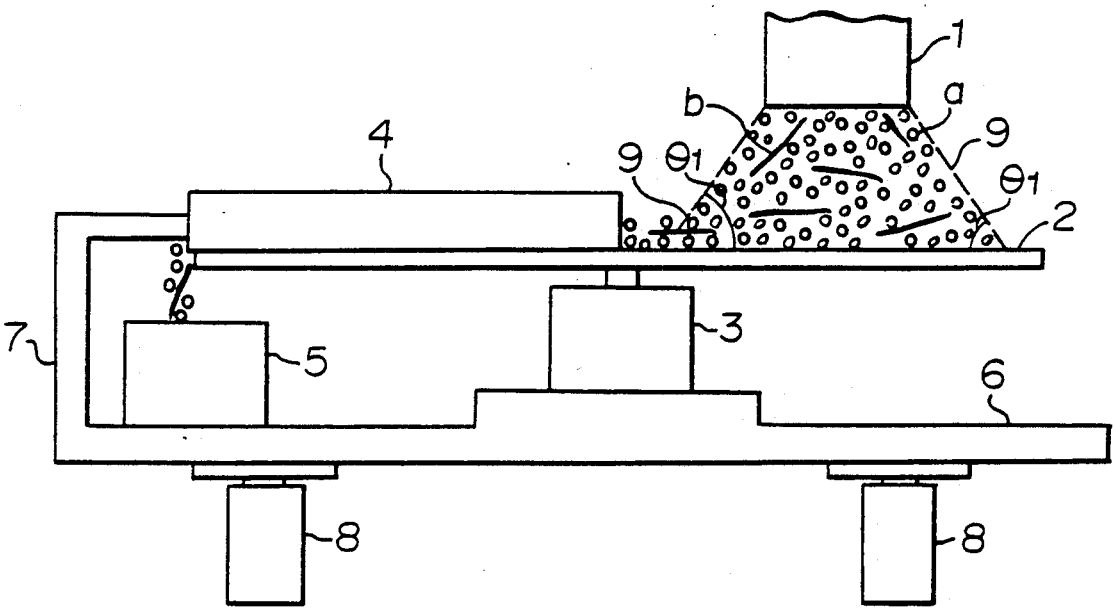
FIG. 3 is another embodiment of this invention.

The support 6 may be disposed on a lift 8 as illustrated in FIG. 3, and the distance between the movable plane member 2 and the edge of the outlet 1 may be changed by operating the lift 8.

FIG. 4 indicates an example in which the edge of the outlet 1 is oblique to the movable plane member 2.

FIG. 5 indicates an example in which the edge of circular outlet is partially cut off as indicated by 10.

Figure 6:
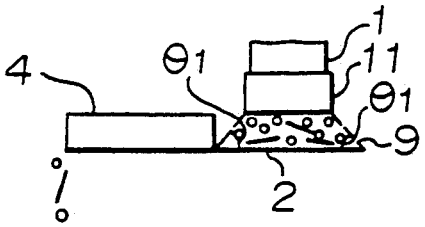
FIG. 6 and FIG. 7 are schematic diagrams indicating the position of the outlet with respect to the guides.

FIG. 6 indicates an example in which the auxiliary circular member is slidably mounted at the edge of the outlet and allows adjustment of the distance between the outlet 1 and the movable plane member 2.

Figure 7:
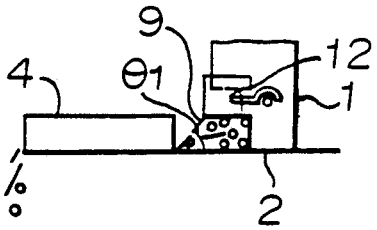

FIG. 7 indicates an example in which a shutter means mounted at the outlet allows the large sized combustion remainder to be removed by being opened.

The examples of the continuous pile of the mixed remainder formed from the accumulation of the mixed remainder which flows from the outlet after the incineration are shown in FIG. 4, FIG. 5, FIG. 7, FIG. 8, FIG. 12 and FIG. 13 and the examples of the continuous pile formed from the whole accumulation are shown in FIG. 1, FIG. 3 and FIG. 6.

FIG. 8 to FIG. 11 illustrate, an example of this invention in an incinerating furnace utilizing hearth particles which form an oblique hearth bed surface of which the angle of the bed is the angle of repose of the mineral particles therein.

Figure 8:
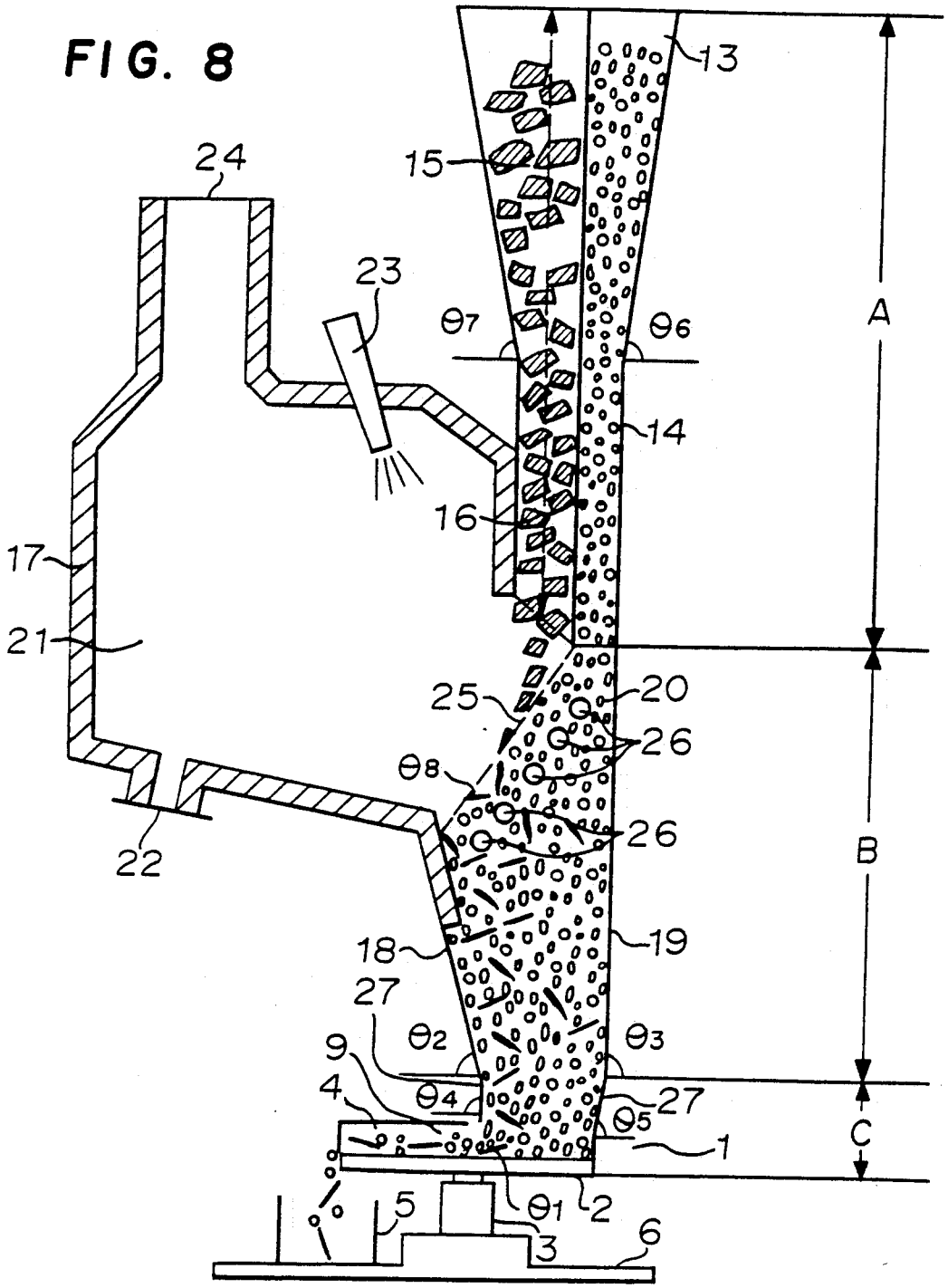
FIG. 8 is an embodiment of this invention indicating the sectional view of the incinerating furnace.

A cross section of the incinerating furnace is illustrated in FIG. 8. Angles of the hearth inlet wall, the incinerating furnace wall and the walls of the incinerating furnace bottom, each of them contacted and covered by the hearth particles, are larger than the angle of repose of the hearth particles. Preferably the bottom opening of the inlet of the materials to be incinerated in the incinerating furnace is disposed at the surface of the hearth bed 25 of the incinerating furnace.

More preferably, at least a single aperture is disposed in the wall of the incinerating furnace for supply of auxiliary air into the incinerating furnace chamber for assisting the incineration in the combustion chamber 21.

A combustion chamber 21, constructed with a hearth consisting of mineral particles and an upper wall, has an main air intake 22, a burner 23 and a combustion gas outlet 24.

Further, the incinerating furnace has a laterally movable plane member 2 at its bottom which continuously or periodically takes out the used hearth particles together with combustion remainder of the burnt materials.

The mixed remainder form a pile on the movable plane member of which the angle of repose is almost the same as the angle of repose of the hearth particles in the combustion chamber.

The distance between the outlet 1 and the movable plane member 2 can be adjusted as described above by operation of the lift 8.

As illustrated in FIG. 8, the inlet of the hearth particles (A) consists of a hopper 13 and a passage 14, and the inlet of the materials to be incinerated (A') consists of a hopper 15 and a passage 16.

The incinerating furnace wall (B) extending from the inlet (A) consists of a front upper wall 17, a front lower wall 18, and a rear wall 19. The front upper wall 17 forms a combustion chamber 21 together with particle hearth bed 20.

The combustion chamber 21 has an air intake 22, a burner 23, and a combustion gas outlet 24. The combustion chamber 21 is generally constructed of heat resistant bricks or heat resistant castable materials.

The incinerating furnace wall (B) has one or more air inlet apertures 26 at the level of the hearth bed surface 25 of the hearth 20 which assists in the combustion of the materials to be incinerated in the combustion chamber 21.

At the bottom of the incinerating furnace wall (B), bottom part (C), which consists of a wall 27 which extends from the lower edge of the front lower wall 18 and of the rear wall 19, forms mixed remainder outlet 1.

A movable plane member 2 is disposed under the outlet 1 and receives the mixed remainder flowing down from the combustion remainder outlet 1. The movable plane member contacts with the collecting guides 4, 4' mounted on the wall 27 and moves laterally.

The movable plane member is driven by the transmission mechanism 3 and mounted on the support 6. The support is mounted on the lift 8 and the distance between the movable plane member 2 and the outlet 1 is adjusted by operating the lift 8.

The guides 4, 4' can be mounted on the arm extending from the support 6.

Figure 9:
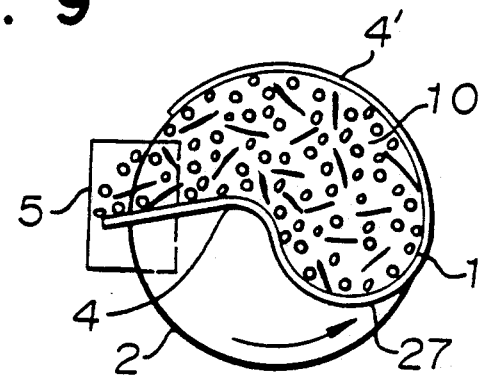
FIG. 9 is a plan view of the incinerating furnace shown in FIG. 8 indicating the bottom of the outlet.

The outlet 1 has a cut off opening 10 as shown in FIG. 9, which allows the mixed remainder to slide or roll down onto the movable plane member 2 and the mixed remainder is moved to the receiving tank 5 as the movable plane member 2 moves and the guides 4, 4' introduce the mixture mixed remainder into the tank 5.

Figure 10:
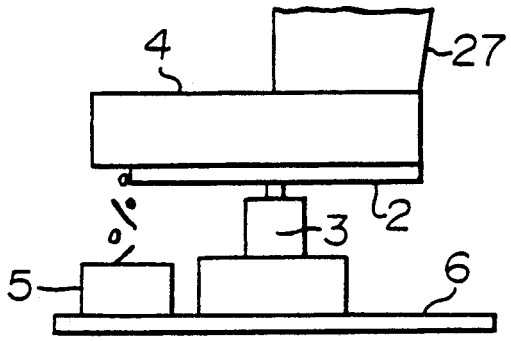
FIG. 10 is a front view of the incinerating furnace shown in FIG. 8.
Figure 11:
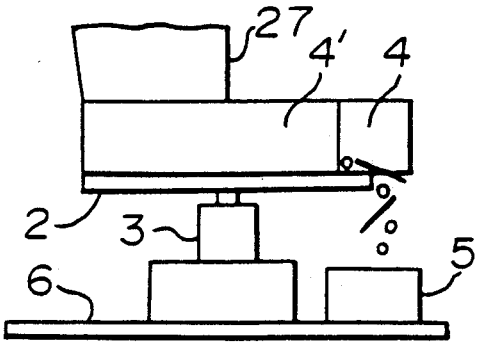
FIG. 11 is a back view of the incinerating furnace.

FIG. 10 is a front view of the outlet 1 and FIG. 11 is a back view of the outlet 1 illustrated in FIG. 8.

Figure 12:
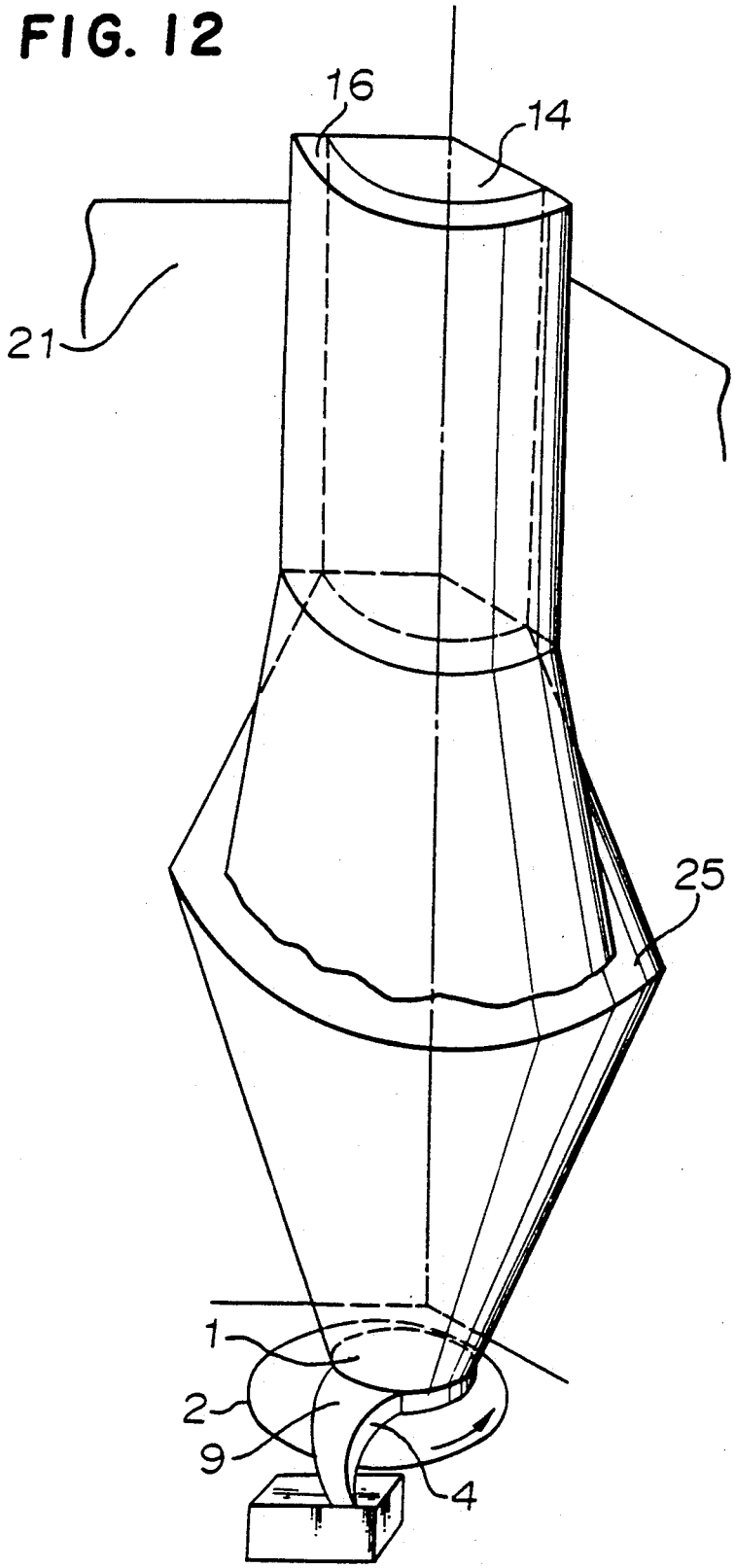
FIG. 12 illustrates another embodiment of the invention.

FIG. 12 illustrates another example of this invention applied to an incinerating furnace constructed at a corner of a solid structure.

In this type of incinerating furnace, the hearth particle inlet 14, the inlet of the materials to be incinerated 16 and the combustion chamber can be much more compact than in conventional incinerating furnaces and, in addition, an oblique hearth bed is automatically formed by supplying hearth particles and crushed materials to be incinerated into the combustion chamber.

1 is an outlet of the mixture of the used hearth particles and the combustion remainders, 2 indicates a movable plane member disposed at the bottom of the furnace for taking out the used hearth particles and the combustion remainders from the incinerating furnace, and a guide 4 guides the mixture of used hearth particles and the combustion remainder to a receiving tank 5.

The distance between the mixed remainder outlet and the movable plane member is adjustable as described in the above mentioned examples.

Figure 13:
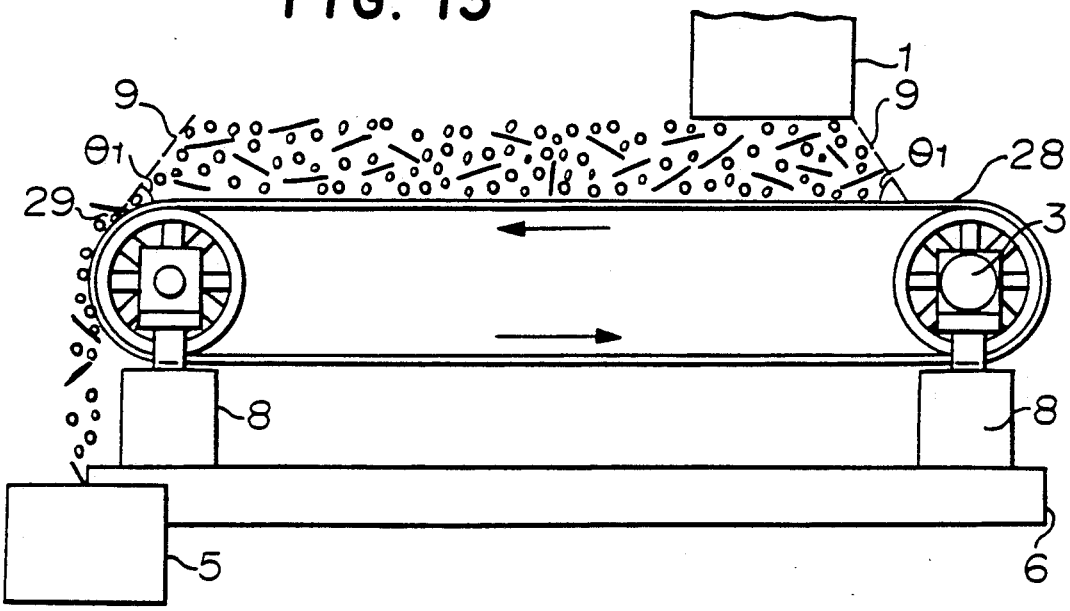
FIG. 13 and FIG. 14 are a side view and a front view of the outlet for the combustion remainder.
Figure 14:
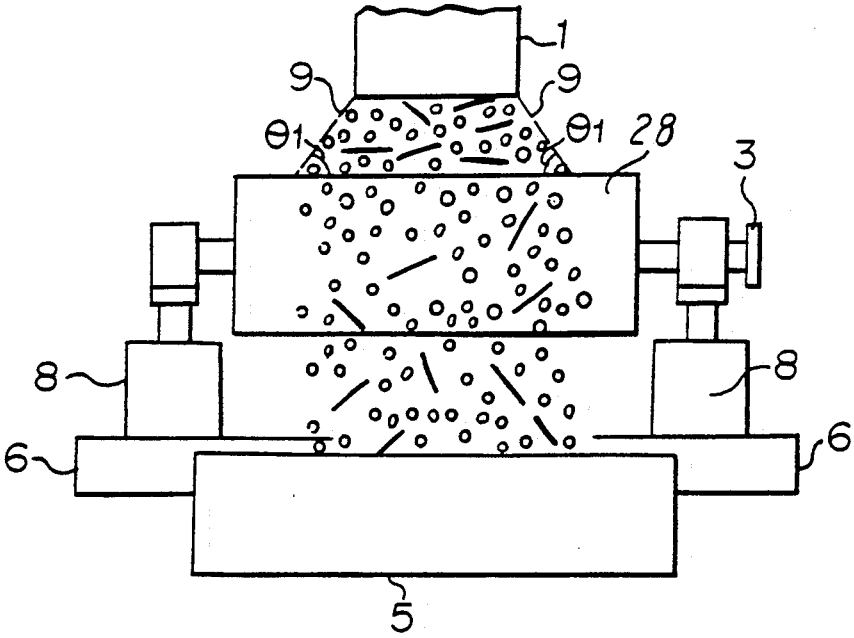

FIG. 13 and FIG. 14 illustrate another embodiment of the outlet of the mixed remainder.

FIG. 13 is a side view of the outlet of the mixed remainder and FIG. 14 is a front view of the mixed remainder.

In FIG. 13 and FIG. 14, the mixed remainder flows down or rolls down from the outlet 1 accumulates on a belt conveyer and forms a continuous pile 9 at a part of or whole of the accumulation.

The pile 9 extends between the outlet 1 and surface of the belt conveyer 28 and the pile angle is the angle of repose $\theta_1$ of the mixed remainder.

It is possible to incinerate not only wastes from daily life, such as plastic wastes, but also coal, brown coal or lignite in the incinerating furnace according to this invention.

After the incineration of the materials to be incinerated, the mixture of used hearth particles and the mixed remainder of the burnt materials slides down onto the movable plane member 2 and forms a pile 9 and the angle of the pile 9 has an angle of repose $\theta_1$ of the mixed remainder.

While the movable plane member 2 stops moving, the pile of the mixture remains stationary and the pile angle is the angle of repose $\theta_1$. Thereby, the mixture of the hearth particles and the combustion remainders from the furnace does not flow down any further.

When the movable plane member 2 starts moving continuously or periodically, the pile of the mixed remainder moves along the movable plane member 2 and reaches the guide 4 and falls into the receiving tank 5 thereby. The remaining mixed remainder in the furnace falls onto the movable plane member 2 forming the pile.

Therefore the pile angle remains the same as the angle of repose $\theta_1$.

The angle of repose $\theta_1$ is a constant value which depends on the material, a shape and size of the particles and crushed materials to be incinerated, and on the combustion condition of the materials to be incinerated.

In general, preferable angle value of the angle of repose is from 10 to 80 degrees, more preferably from 30 to 80 degrees and, further more preferably from 40 to 70 degrees.

The dimension of the movable plane member is determined depending on the angle of repose of the mixed remainder and the location of the outlet of the mixed remainder so that the bottom edge of the pile would not go off the movable plane member 2.

As illustrated in FIG. 13 and FIG. 14, the mixed remainder flowing from the outlet 1 and forming the pile 9 is transferred by the belt conveyer 28, which is an example of a movable plane member 2, to the other end 29 of the belt conveyer 28 and falls into the receiving tank 5.

The belt conveyer 28 is driven by a driving unit 3 and may be secured on a lift 8 disposed on a support 6 so as to change the distance between the remainder outlet 1 and the surface of the belt conveyer.

We have disclosed herewith a rotary table and belt conveyer as the examples of the movable plane member in the discussed embodiments. Other examples of movable plane members; such as a caterpillar like conveyer or other types of conveyers, are also applicable to this invention.

The distance between the movable plane member 2 and the mixed remainder outlet can be bigger when the angle of repose of the mixed remainder is big.

The hearth particles are supplied from the hopper 13 and fall or roll down by the gravity through the inlet 14 and furnace wall (B), and accumulate at the bottom of the furnace (C).

The bottom of the furnace is first filled with hearth particles, then the furnace wall part (B) is filled and, finally the rear wall part is also filled with hearth particles up to the inlet 14. Therefore the surface of rear wall 19 is covered with hearth particles, thereby forming the oblique hearth 20.

The inclined slope of the hearth particles, which is the surface of the particle hearth bed 25, is formed between the lower part of the inlet 14 and the front furnace wall 18, which forms an opening towards the combustion chamber 21, and the angle of the slope, depending on the material of the particles, is the angle of repose of the particles $\theta_8$.

One of the features of this invention is the surface of the hearth is oblique as to the horizontal with, the angle value being preferably from 10 to 80 degrees, more preferably from 30 to 80 degrees and, further more preferably from 40 to 70 degrees.

For instance, the angel of repose of dried sand is 40 degrees and that of crushed stones having cleavage planes is larger than 80 degree so it is possible to form a steep surface for the hearth.

This improved furnace is constructed so that the incineration is conducted not only in the oblique direction but also almost in the horizontal direction.

When interaction of the main air intake 22 with the auxiliary air inlet apertures 26 is expected, the flame of the combustion in the combustion chamber may go up along the hearth bed 25 of the furnace.

As the angles of all parts of the passages of the hearth particles, for instance the angle of lower front wall 18 $\theta_2$, of the rear wall 19 $\theta_3$, of the front edge of the wall 27 $\theta_4$, of the rear edge of the wall 27 $\theta_5$, of the hearth particles hopper 13 $\theta_6$, and the angle of the materials to be incinerated hopper 15 $\theta_7$, are constructed larger than the angle of repose $\theta_8$ (the slope angle of the hearth bed 25), so that the hearth particles can slide or roll down the pile of those passage parts and no clogging of the particles will occur.

Materials to be incinerated are put into the furnace through the hopper 15 and the inlet of the materials to be incinerated 16 and fall onto the hearth bed 25. The lower end of the inlet 16 is preferably disposed just above the hearth bed 25, the materials to be incinerated slide or roll down on the hearth bed 25 and will never go down outside the hearth bed 25. Therefore, the materials to be incinerated are always incinerated completely and it is an advantage of this invention that the walls of the furnace never contact with the incinerating materials which are at high temperature because the walls are covered with hearth particles. Especially when air is introduced through the auxiliary air inlet apertures 26, combustion in the combustion chamber becomes strong and unburnt, burnt remainings will not be observed in the furnace chamber.

The auxiliary air inlet aperture 26 consists of a pipe having holes therein, and installation of these apertures to the furnace wall is very easy because there is no mechanical relation between the apertures and the surrounding parts of the furnace.

A burner 23 is utilized as an auxiliary combustion means in the chamber 21 and sprays an aerosol of combustible liquid and the combustion is conducted on the furnace bed 25.

As the combustion in the combustion chamber starts, the movable plane member 2 starts moving continuously or periodically to remove the hearth particles accumulated on the movable plane member 2 and the guide 4 introduces the mixed remainder down into the receiving tank 5.

As the used hearth particles are taken out from the outlet 1 of the furnace, materials incinerated on the furnace bed 25 are dragged into the hearth particles, mixed with said hearth particles and fall down. Then the supplemental hearth particles come down from the hopper 13 and form the surface of the furnace bed 25 of which the angle remains the same as $\theta_1$.

The mixture of used hearth particles (a) and the combustion remainders (b) fall down the furnace wall part (B) and the bottom part (C), fall down from the outlet 1 and from a pile 9 on the movable plane member 2, and the pile angle is $\theta_1$.

As the movable plane member 2 moves continuously or periodically, the mixture is carried to the opposite side of the movable plane member where the guide 4 is disposed and the mixture is introduced down into the receiving tank 5 by the guide 4.

It is one of the options of the present invention to grade the mixtures by a sieve and to recyle the recovered hearth particles by refining.

The angle of the pile $\theta_1$ is constant depending on the material making up the pile and, the size of the particles, and is almost the same as the angle of the hearth bed surface angle $\theta_8$.

It is another option of the present invention to grade the mixtures by the sieve and to recyle the recovered hearth particles by refining.

The angle of the pile $\theta_1$ is constant, depending on the material making up the pile, the size of the particles, and is almost the same as the angle of the hearth bed pile angle $\theta_8$. The bigger angle $\theta_1$ is, the larger the distance between the outlet 1 and the movable plane member 2 can be because the bottom area 9 of the mixed remainder will be smaller if the angle of repose is large.

In case the edge of the outlet 1 has a cut off opening, the width of the cut off opening is preferably as large as possible within the diameter of the outlet.

When a forced draft system is equipped in the furnace exhaust system, the air is introduced through the hopper, when the hoppers 13, 15 are open, into the combustion chamber 21, which helps combustion in the chamber, and the extra air will prevent the generation of bad odors.

When the flue gas contains harmful components, such as HCl, SOx, and NOx, it is recommended to attach a gas removal system, such as a wash tower to the incinerating furnace tower to remove those harmful components.

PREFERRED EMBODIMENT

In the furnace illustrated in FIG. 8, in which the hearth particles are crushed stones of serpentinite, produced in Chichibu area of Saitama Pref. Japan, having mean diameter of 10 mm, the area of the furnace bed is 0.1 $m^2$ (0.2 m$\times$0.5 m) and used disposable plastic injectors are crushed and incinerated in the furnace.

The angles of the walls of the furnace are $\theta_2=75°$, $\theta_3=90°$, $\theta_4=90°$, $\theta_5=80°$, $\theta_6=80°$, $\theta_7=80°$. The area of the outlet of the mixed remainder 1 is 0.05 $m^2$ and the distance between the outlet 1 and the rotary table 2 is 30 cm.

Fresh air mixed with combustion exhaust gas having a temperature about 300 ° C. is introduced from the auxiliary air inlet 26 at a rate 5 $Nm^3$/min and the crushed plastics to be incinerated are supplied at a rate of 5 kg/hr. The materials are all incinerated completely.

The mixture of the used hearth particles and the inorganic combustion remainder contained in the materials to be incinerated is taken out at a rate of about 0.1 kg/hr from the outlet 1. The angle of the furnace bed surface $\theta_8$ is in the range of from 50° to 60° during the incineration. The angle of the pile $\theta_1$ is the same as the angle of the furnace bed $\theta_8$. The biggest combustion remainder of 10 cm length is easily taken out from the outlet 1 and introduced into the receiving tank 5.

When hour continuous operation was conducted using this furnace, no damages in the walls and the bottom was observed during the operation.

The hearth particles of crushed stones of serpentinite having magnesium silicate as a main component show stable characteristic against high temperature exposure at 1000° C. and no change is observed in the used ones.

ADVANTAGE OF THE INVENTION

A mixed remainder is taken out through the outlet and the rotary table which makes it possible to easily take out comparatively large sized combustion remainders and to prevent free downward flow of mixed remainder from the outlet.

The furnace bed of this invention is renewed by the down flow of the hearth particles by gravity and, no special apparatus such as a belt conveyer is necessary to transfer the hearth particles to the combustion chamber so the structure of the furnace can be simple and is easy to manufacture.

The furnace bed of this invention is oblique as described before and the size of the furnace can be comparatively compact though the capacity of the furnace is large. Consequently the area of the furnace can be smaller when the angle of the hearth bed is large, that is, the angle of repose of the particles is large.

Though the materials to be incinerated have bad smelling components or emit harmful gases, such as HCl, SOx, or NOx, incineration in this furnace is perfect as the air supply of this furnace is complete and, in addition harmful gas removing apparatuses can easily be attached thereto and emission of the harmful gases prevented.

Even materials to be incinerated containing plastics having high calorific value can be incinerated in this furnace without any damage being caused by the flame to the walls and the bottom of the furnace.

What is claimed is:

1. An incinerating furnace which utilizes hearth particles as a fixed hearth bed or a movable hearth bed, said furnace comprising: a hopper having hearth particles contained therein; a combustion chamber containing a hearth particle bed, said hearth particle bed having a sloped surface of an angle about equal to the angle of repose of said hearth particles; a first passageway connecting said hopper with said combustion chamber and positioned with respect to said hopper and said combustion chamber such that said hearth particles can be supplied to said heart particle bed from said hopper by gravity flow through said first passageway; a waste materials bin containing waste materials to be incinerated in said combustion chamber; a second passageway connecting said bin with said combustion chamber and positioned with respect to said bin and said combustion chamber such that said waste materials are supplied onto the sloped surface of said hearth particle bed from said bin through said second passageway; an outlet for discharging a mixture of used hearth particles and combustion remainder, said outlet being provided at a lower portion of said furnace; and a movable plane member for removing said mixture of used hearth particles and combustion remainder discharged from said outlet, said movable plane member being positioned underneath said outlet at a distance such that at least a part of said mixture forms a continuous bed extending between said outlet and the surface of said movable plane member, said mixture bed having a sloped surface of an angle about equal to the angle of repose of said mixture.

2. An incinerating furnace which utilizes hearth particles as a fixed hearth bed or a movable hearth bed, said furnace comprising: a hopper having hearth particles contained therein; a combustion chamber containing a hearth particle bed, said hearth particle bed having a sloped surface of an angle about equal to the angle of repose of said hearth particles; a passageway connecting said hopper to said combustion chamber; a waste materials bin containing waste materials to be incinerated in said combustion chamber; an outlet for discharging a mixture of used hearth particles and combustion remainder, said outlet being provided at a lower portion of said furnace; and a movable plane member for removing said mixture of used hearth particles and combustion remainder discharged from said outlet, said movable plane member being positioned underneath said outlet at a distance such that at least a part of said mixture forms a continuous bed extending between said outlet and the surface of said movable plane member, said mixture bed having a sloped surface of an angle about equal to the angle of repose of said mixture and said mixture flowing downward onto said movable plane member as said movable plane member moves to discharge said mixture bed contained thereon.

3. An incinerating furnace according to claim 2, wherein the movable plane member is selected from the group consisting of a rotary table, a belt conveyor or a caterpillar conveyor.

4. An incinerating furnace according to claim 1, wherein said mixture bed's sloped surface is of an angle of about 40 to 70 degrees.

5. An incinerating furnace according to claim 2, wherein said mixture bed's sloped surface is of an angle of about 40 to 70 degrees.

6. An incinerating furnace according to claim 1, wherein said hearth particle bed's sloped surface is of an angle of about 40 to 70 degrees.

7. An incinerating furnace according to claim 2, wherein said hearth particle bed's sloped surface is of an angle of about 40 to 70 degrees.

8. An incinerating furnace according to claim 1, wherein said furnace additionally comprises a front furnace wall and a rear furnace wall, said front and rear furnace walls each being of an angle, with respect to a horizontal plane, greater than said angle of repose of said hearth particles.

9. An incinerating furnace according to claim 2, wherein said furnace additionally comprises a front furnace wall and a rear furnace wall, said front and rear furnace walls each being of an angle, with respect to a horizontal plane, greater than said angle of repose of said hearth particles.

* * * * *